US008061870B2

(12) United States Patent
Pearson et al.

(10) Patent No.: US 8,061,870 B2
(45) Date of Patent: Nov. 22, 2011

(54) SEAT LIGHT AND BACKLIT PLAQUE HOLDER

(75) Inventors: Dennis Pearson, Foothill Ranch, CA (US); Guang Jin, Santa Monica, CA (US)

(73) Assignee: Tempo Industries, Irvine, CA (US)

( * ) Notice: Subject to any disclaimer, the term of this patent is extended or adjusted under 35 U.S.C. 154(b) by 0 days.

(21) Appl. No.: 12/787,814

(22) Filed: May 26, 2010

(65) Prior Publication Data

US 2011/0032703 A1 Feb. 10, 2011

Related U.S. Application Data

(60) Provisional application No. 61/232,335, filed on Aug. 7, 2009.

(51) Int. Cl.
*F21S 4/00* (2006.01)
*F21V 21/00* (2006.01)

(52) U.S. Cl. ..... 362/249.02; 362/145; 362/800

(58) Field of Classification Search ..... 362/145–151, 362/249.02, 800; 40/541–583
See application file for complete search history.

(56) References Cited

U.S. PATENT DOCUMENTS

| | | | | |
|---|---|---|---|---|
| 6,213,622 | B1 | 4/2001 | Shimada | |
| 6,554,446 | B1 * | 4/2003 | Walsh et al. | 362/146 |
| 6,595,671 | B2 | 7/2003 | Lefebvre et al. | |
| 7,160,007 | B2 | 1/2007 | Pan | |
| 2005/0265019 | A1 | 12/2005 | Sommers et al. | |
| 2008/0002399 | A1 | 1/2008 | Villard et al. | |
| 2010/0091489 | A1 | 4/2010 | Pearson et al. | |

OTHER PUBLICATIONS

Tempo Industries, 3700 Series Sentinel, "Sentry Seat-Mounted Lighting" 2 pages (2005) Tempo Industries, Irvine, CA.

Tempo Industries, Sentinel System, "Wall Mounted LED Stair Lighting System" 2 pages (2002) Tempo Industries, Irvine, CA.

Tempo Industries, Sentinel System, "Rail & Seat Mounted LED Stair Lighting Products" 1 Page (2002) Tempo Industries, Irvine, CA.

Tempo Industries, Sentinel System, "2100GS—Single Step—Grey Stripe Left or Right End Cap" 2 pages (2002) Tempo Industries, Irvine, CA.

Tempo Industries, Guardian (Orange Sidebar), "Tread/Riser Stair Nose Lighting" 3 Pages (2005) Tempo Industries, Irvine, CA.

Tempo Industries, Guardian (Orange Sidebar), "Step Edge Lighting" 2 Pages (2005) Tempo Industries, Irvine, CA.

Tempo Industries, Sentinel (Yellow Sidebar), "Sentinel Striped Step Nose" 2 Pages (2005) Tempo Industries, Irvine, CA.

Tempo Industries, Internal Drawing, Never Published (drawing of rail light installed at 10 Deg.) 1 Page (2002) Tempo Industries, Irvine, CA.

Tempo Industries, Sentinel with biinary technology, "Product Brochure Wall Light, Rail Light, Striped Step Nose" 8 Pages (2007) Tempo Industries, Irvine, CA.

* cited by examiner

*Primary Examiner* — Jason Moon Han

(74) *Attorney, Agent, or Firm* — Greenberg Traurig LLP; Franklin D. Ubell

(57) ABSTRACT

A seat light and plaque holder including a seat light base having a downwardly angled mounting surface and an upwardly angled mounting surface with a first plurality of LEDs mounted on the downwardly angled mounting surface and a second plurality of LEDs is mounted on the upwardly angled mounting surface. A light cover is attached to the seat light base having a row marker positioned thereon to be backlit by the second plurality of LEDs and an end portion of a length selected to shield the downwardly angled first plurality of LEDs from view of persons walking up or down an aisleway while directing illumination towards an aisleway.

16 Claims, 9 Drawing Sheets

SEAT LIGHT AND BACKLIT PLAQUE HOLDER

CROSS REFERENCE TO RELATED APPLICATIONS

This application claims the benefit of and priority to U.S. Provisional Application Ser. No. 61/232,335, filed Aug. 7, 2009, entitled, "Seat Light and Backlit Plaque Holder," the contents of which are incorporated by reference herein in its entirety.

BACKGROUND

1. Field

The subject disclosure relates to lighting and lighting fixtures and more particularly to a self-contained LED light fixture particularly useful in a seat-mounted aisle and stairway lighting configuration.

2. Related Art

In the past, aisle lighting has been used in theatres and other venues for assisting patrons in ascending and descending aisles, stairways, and the like.

SUMMARY

The following is a summary of various aspects and advantages realizable according to various embodiments of the invention. It is provided as an introduction to assist those skilled in the art to more rapidly assimilate the detailed discussion which ensues and does not and is not intended in any way to limit the scope of the claims which are appended hereto in order to particularly point out the invention.

In an illustrative embodiment, a seat light and plaque holder comprises a seat light base having a downwardly angled mounting surface and an upwardly angled mounting surface. An LED shroud containing a circuit board and a first plurality of LEDs is mounted on the downwardly angled mounting surface, while a second plurality of LEDs is mounted on the upwardly angled mounting surface. A light cover is attached to the seat light base and has a row marker positioned thereon to be backlit by the second plurality of LEDs. The light cover further has an end portion of a length selected to shield the downwardly angled LEDs from view of persons walking up or down an aisleway while directing illumination towards the aisleway. The positioning of the LEDs and shape of the cover thus cooperate to direct light down toward an adjacent aisleway, while concealing the shroud and LEDs from normal view.

DRAWINGS

The features of the present disclosure will become more apparent with reference to the following description taken in conjunction with the accompanying drawings wherein like reference numerals denote like elements and in which.

DETAILED DESCRIPTION

Figure 1:
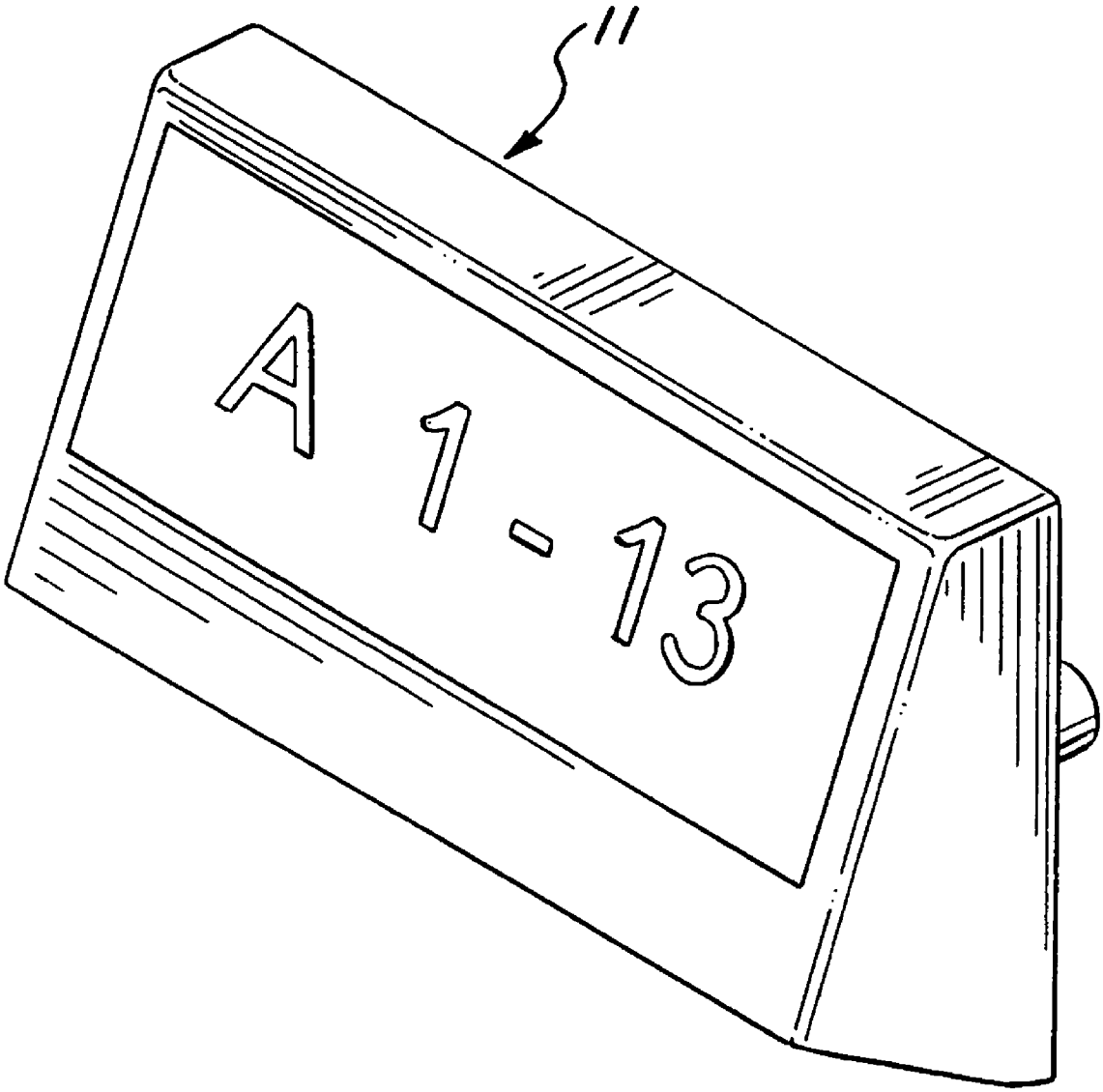
FIG. 1 is a side perspective view of a seat light and plaque holder according to an illustrative embodiment.

A seat light and plaque holder 11 according to an illustrative embodiment is shown in FIGS. 1-4. As best seen in the exploded view of FIG. 4, the seat light and plaque holder 11 includes an aisle light LED circuit board 17, a board shroud or holder 19, which encases the board 17, and a light base 21, which receives and mounts the board shroud 19 and its encased LED board 17. The LED circuit board 17 further mounts a number of LED's 30, 31, 32, 33.

In one embodiment, the light base 21 is a single piece molded or cast component designed to attach to the side of a theatre aisle seat or other surface. The light base 21 further mounts a backlight LED circuit board 23 and positions the backlight circuit LED board 23 to backlight a row marker 25 or other plaque with light passed through a diffuser 27.

The row marker 25 is mounted in a light cover 29, which is further designed to direct illumination from the LEDs 30, 31, 32, 33 onto an aisle way, while at the same time concealing the shroud 19 and the LEDs 30, 31, 32, 33 from normal view. In the illustrative embodiment, the light cover 29 is a single piece molded or cast part and includes a generally rectangular frame portion 113, which has opposite parallel flat sides 26, 28 having straight back edges 32, 34 which flushly abut the light base 21 when the unit is assembled.

The light cover 29 further contains a rectangular well 115 for receiving and holding the rectangular plaque 25. As noted, the plaque 25 carries an indicator such as a row marker comprising alpha and/or numeric indicia, which is backlit by a number of LED's 24 to enhance its visibility.

Figure 9:
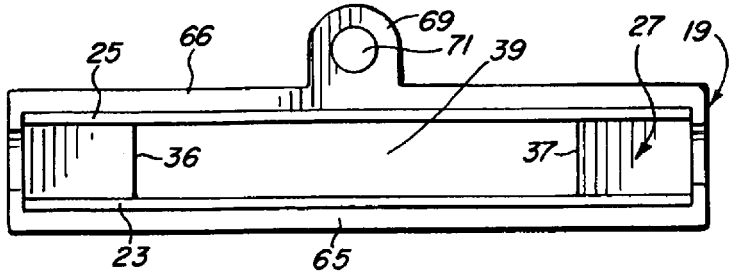
FIG. 9 is a back view of the shroud component of FIG. 6.
Figure 8:
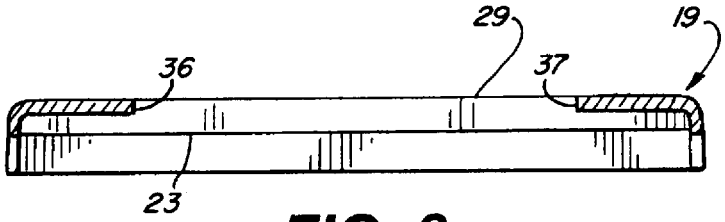
FIG. 8 is a sectional view of the shroud component taken at 8-8 of FIG. 6.
Figure 7:
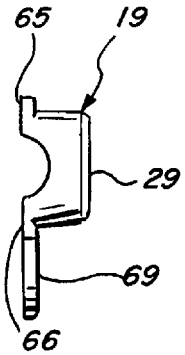
FIG. 7 is a side view of the shroud component of FIG. 6.
Figure 6:
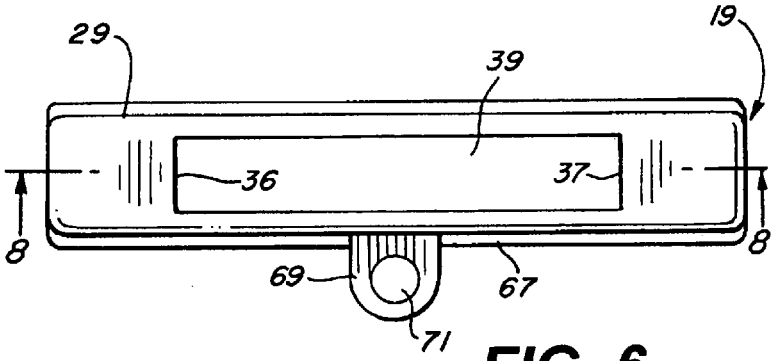
FIG. 6 is a front view of a shroud component of an illustrative embodiment.
Figure 10:
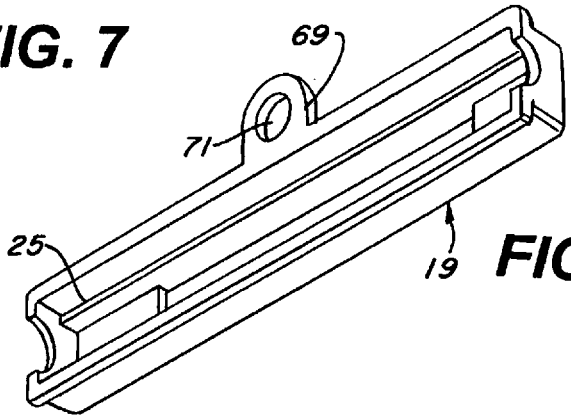
FIG. 10 is a rear perspective view of the shroud component of FIG. 6.
Figure 11:
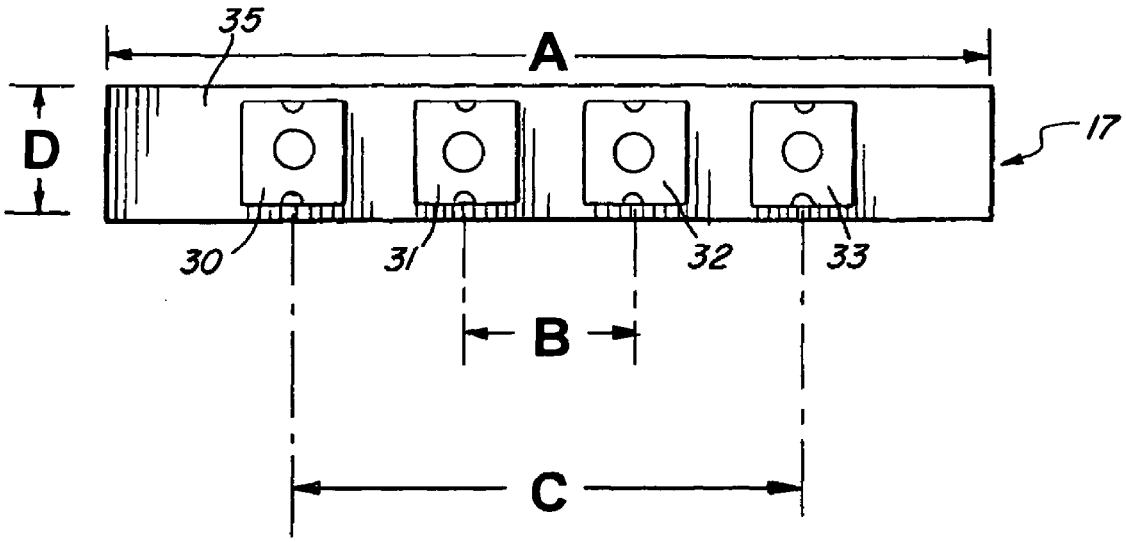
FIG. 11 is top view of an LED circuit board according to an illustrative embodiment.

In one illustrative embodiment, the front surface 35 of the aisle light LED circuit board 17, shown, e.g. in FIG. 11, fits flush against parallel horizontal rims 23, 25 (FIG. 9) located on the interior surface 27 of the board shroud 19. In one embodiment, the parallel rims 23, 25 position the circuit board 17 such that the front surfaces of the LEDs 30-33 lie flush with the front surface 29 of the shroud 19. The end most LEDs 30, 33 are positioned on the board 17 such that they abut the respective vertical edges 36, 37 of the rectangular opening 39 in the front surface of the shroud 19. This abutment positions the board 17 and prevents lateral sliding of the board 17 with respect to the inner rims 23, 25. The number of LEDs may be varied, e.g. from two to four in illustrative embodiments.

Figure 4:
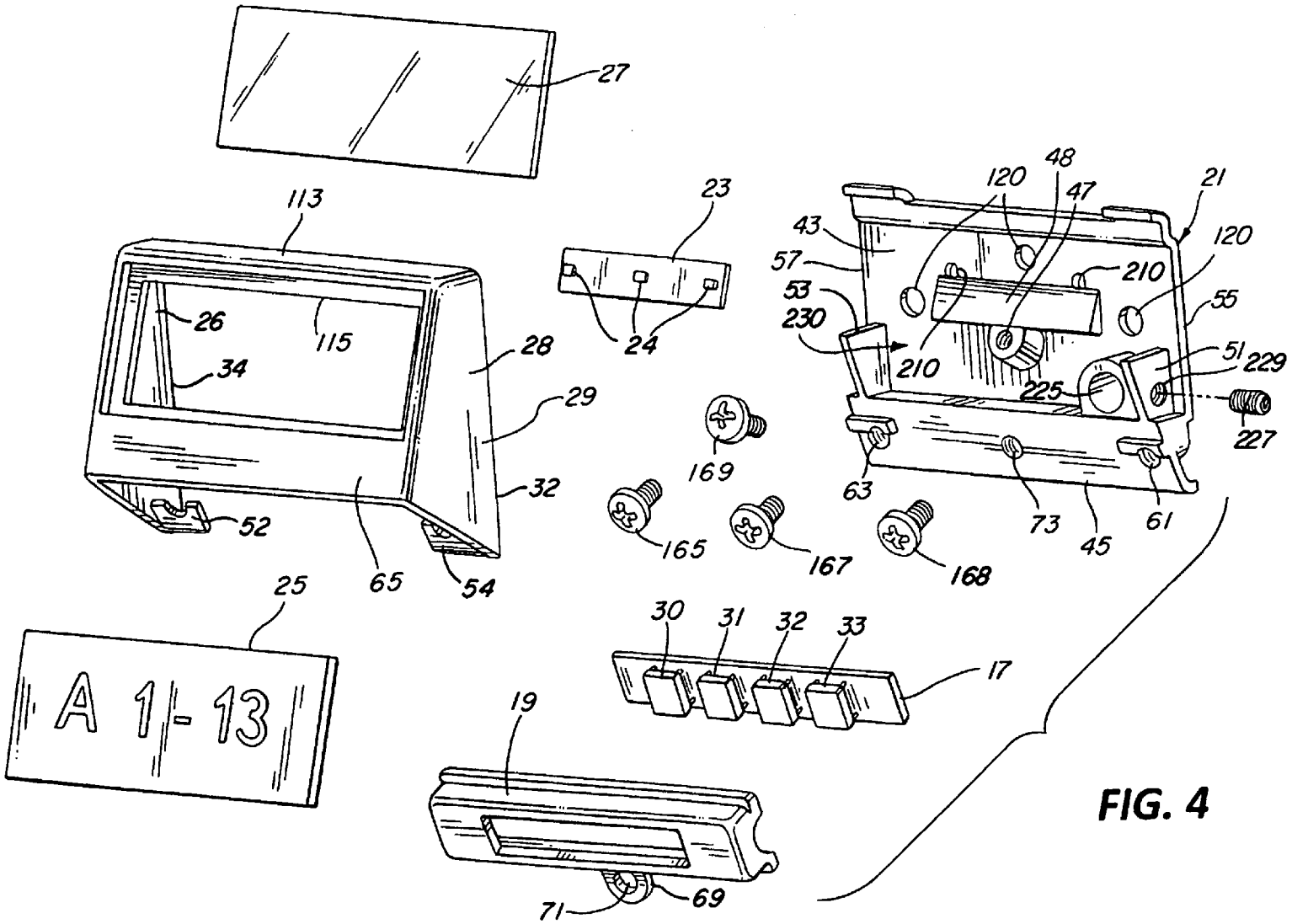
FIG. 4 is an exploded perspective illustrating components of the embodiment of FIG. 1.
Figure 5:
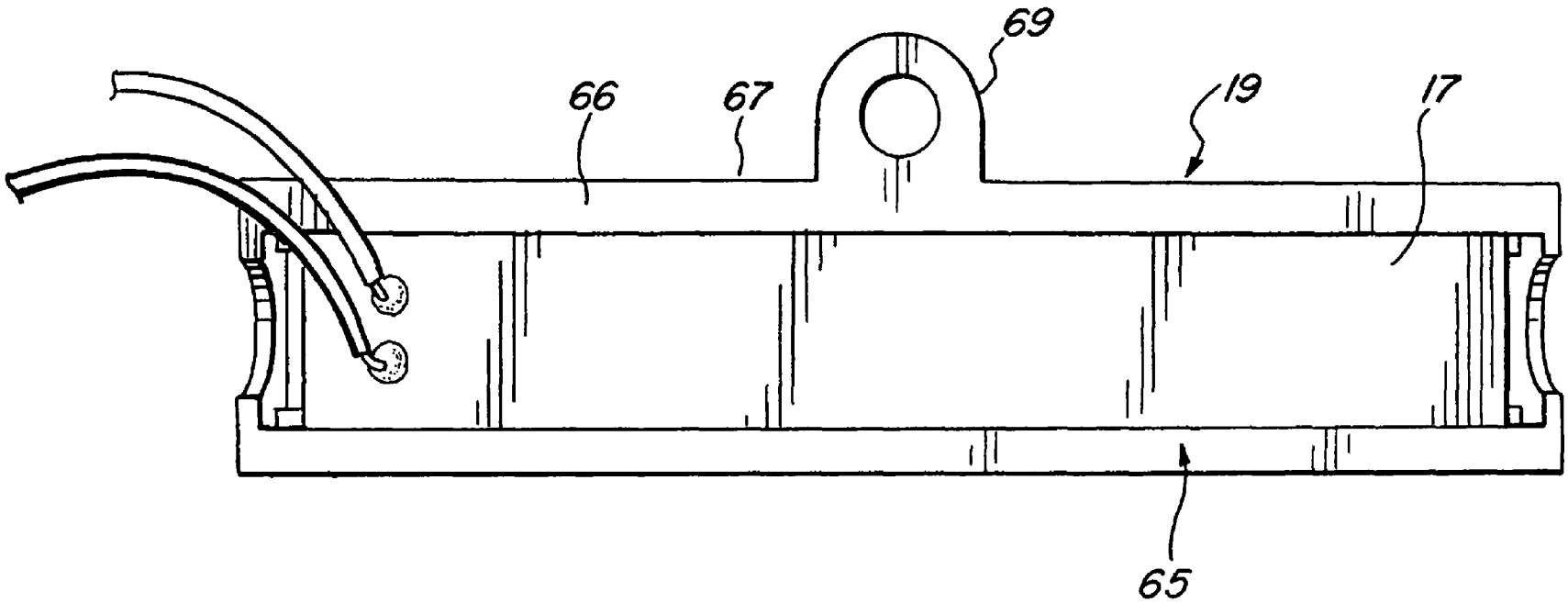
FIG. 5 is a rear view of the shroud and circuit board components of FIG. 4.
Figure 14:
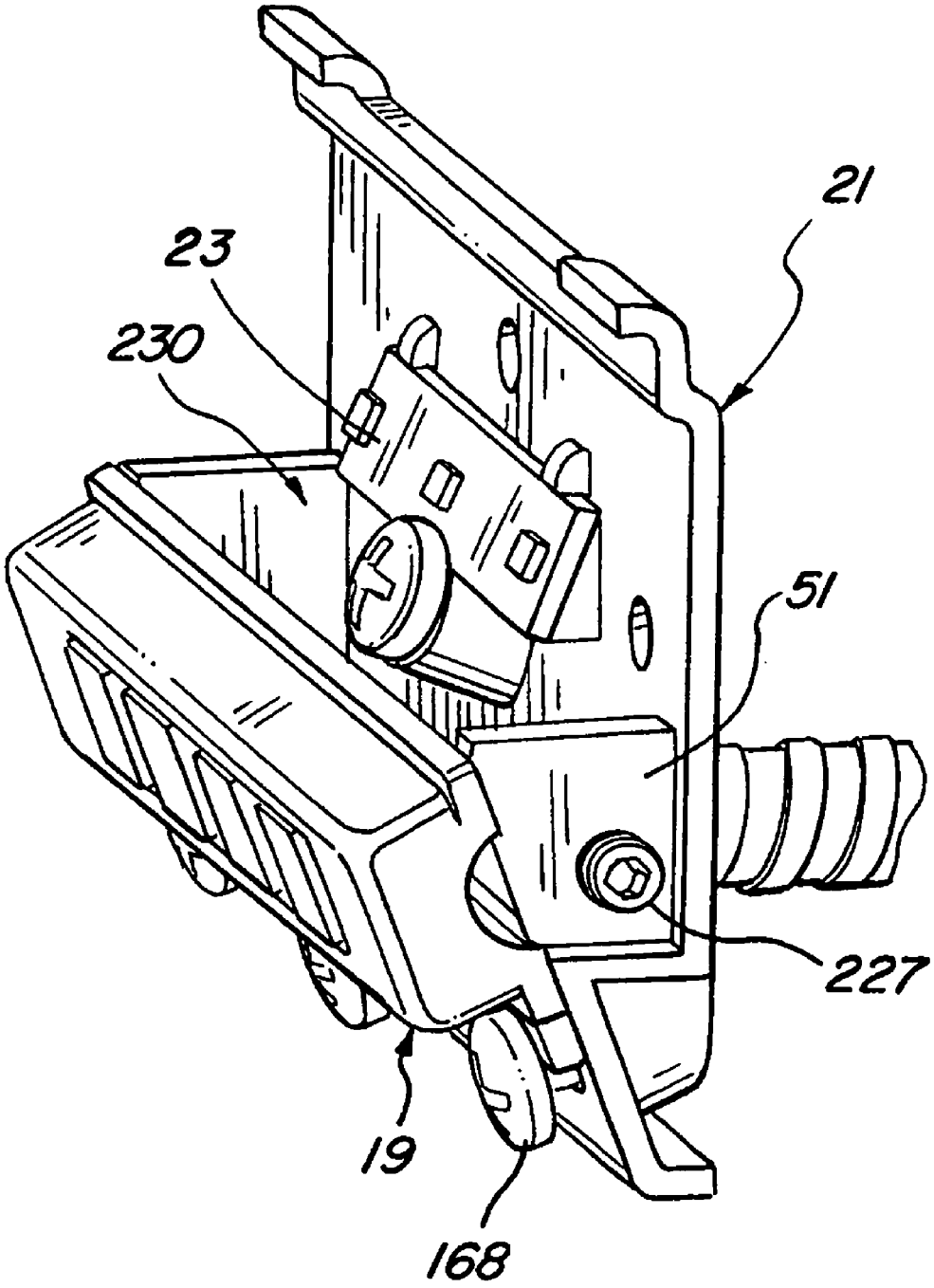
FIG. 14 is a perspective view illustrating backlight and aisle light circuit boards attached to a light base component.

As shown in FIG. 4, the vertical rear surface 43 of the light base 21 includes a central threaded opening 47 for receiving a screw 169 and includes respective pads 51, 53 at its respective ends 55, 57. The pads 51, 53 abut and properly position the light shroud 19 with respect to the light base 21, as further illustrated in FIG. 14. The light base 21 further includes a first angled mounting surface 45 and a second angled mounting surface 48. The second mounting surface 48 is formed on the generally flat vertical surface 43 of the light base 21.

The first angled mounting surface 45 has first and second mounting holes 61, 63 which receive screws 165, 168, which engage tabs 52, 54 to fasten the light cover 29 to the mounting surface 45. The backlight circuit board 23 mounts on the second angled planar mounting surface 48 which positions the circuit board at an angle β (FIG. 3) of, for example, 20 degrees to the vertical. As further seen in FIG. 3, the backlight circuit board 23 is retained by overlying lips 210 and the underside edge of the head of the screw 169.

Figure 3:
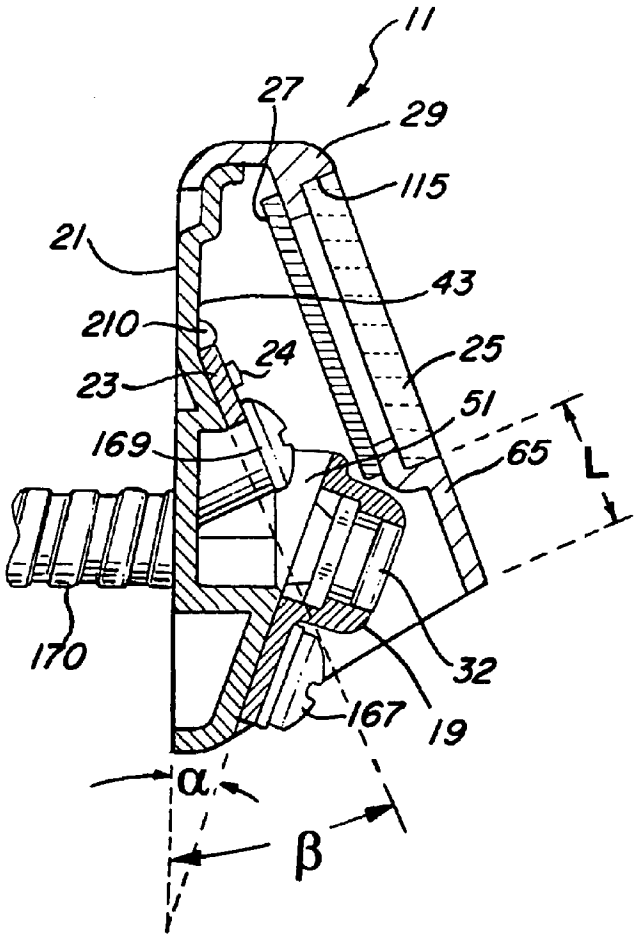
FIG. 3 is a sectional view taken at 3-3 of FIG. 2.
Figure 2:
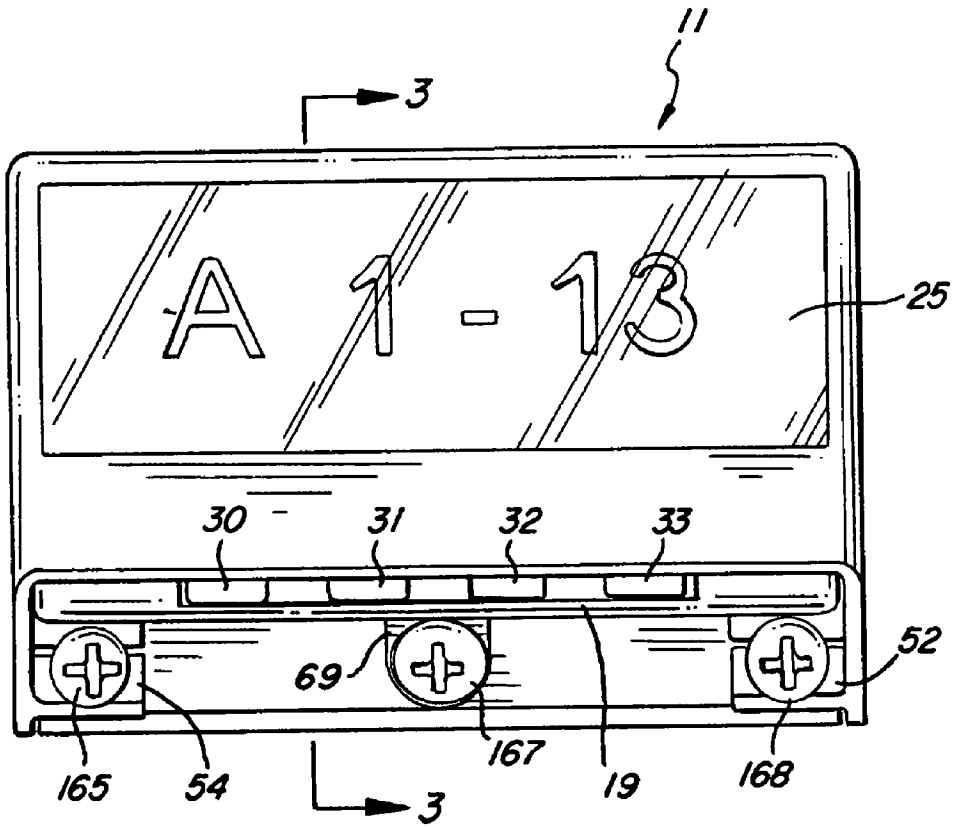
FIG. 2 is a front view of the embodiment of FIG. 1.

As also seen in FIG. 3, in the illustrative embodiment, the plane of the LED circuit board 17 and mounting surface 45 are positioned at an acute angle α of, for example, 20 degrees to the vertical such that the light from the LEDs 30, 31, 32, 33 is directed out and downwardly. The end portion 65 of the light cover 29 is of a length "L" selected to be sufficient to shield the LED bank from the view of persons walking up or down an aisleway, while still directing sufficient light on to the aisleway to properly illuminate it.

Figure 13:
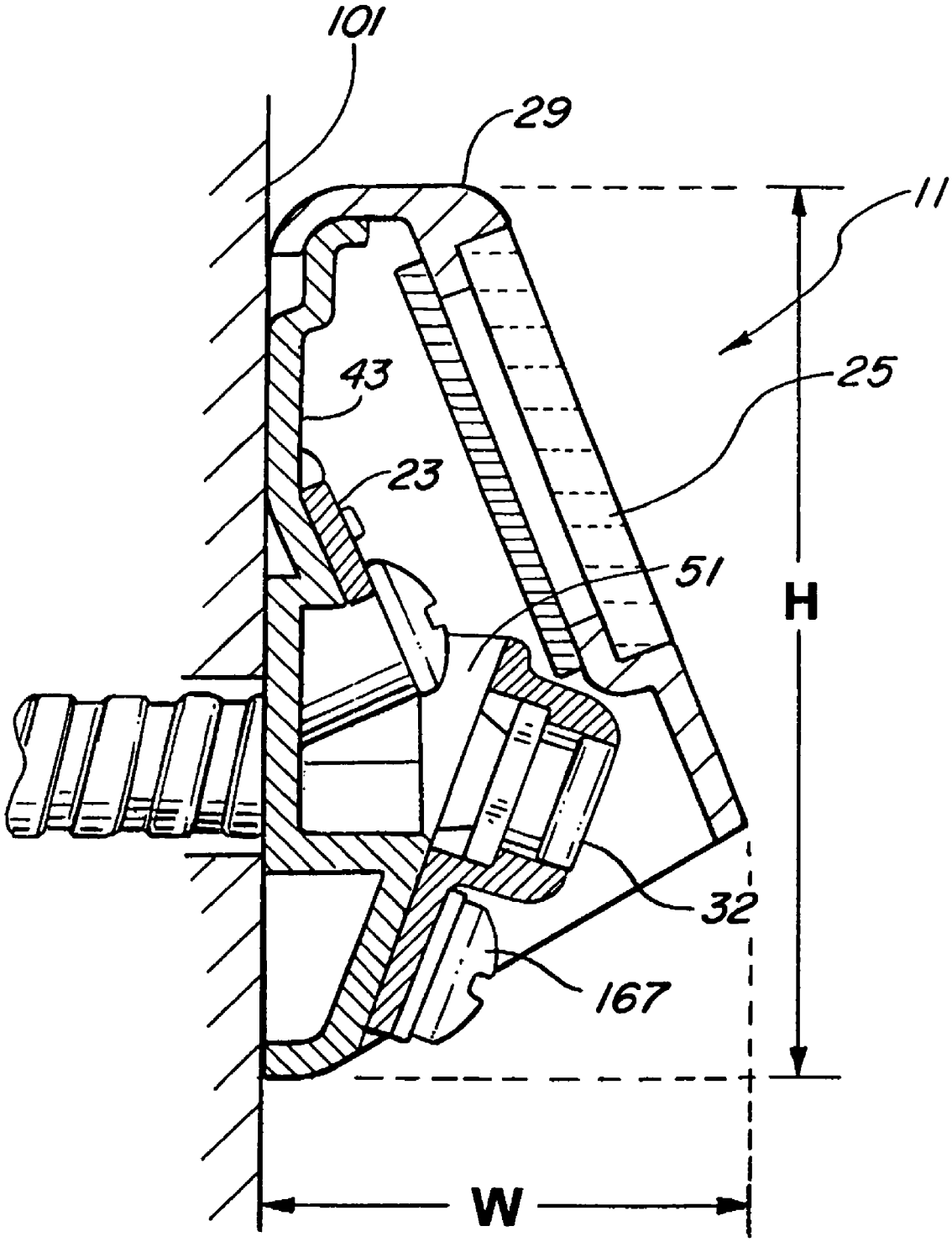
FIG. 13 is a side sectional view of an illustrative embodiment mounted to a seat sidewall.

As illustrated in FIGS. 4 and 6-10, the lower edge 67 of the circuit board shroud 19 has a tab 69 formed thereon, which has a mounting hole 71 positioned to concentrically align with another mounting hole 73 formed in the lower planar surface 41 of the light base 21. Thus, a single fastening device 167 can be used to attach the board shroud 19 to the light base 21. Suitable screws or other fastening means may be inserted through holes 120 to fasten the light base 21 to a mounting surface such as a seat sidewall 101, as shown in FIG. 13. As further illustrated in FIG. 13, the overall height "H" and width "W" of one illustrative embodiment may be 2.0 inches and 1.0 inches, respectively.

Figure 12:
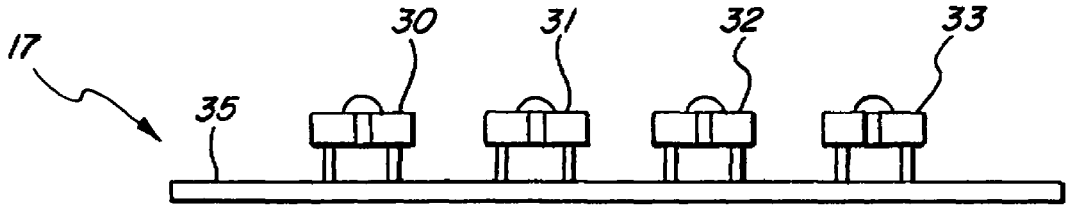
FIG. 12 is a side view of the LED circuit board of FIG. 11.

One embodiment of an aisle light LED circuit board 17 is illustrated in further detail in FIGS. 11 and 12. In one embodiment, the circuit board 17 includes the four LED's 30, 31, 32, 33. Illustrative dimensions of one embodiment of a board 17 are A=2.625 inches, B=0.500 inches, C=1.500 inches and D=0.375 inches. In one embodiment, the backlight LEDs 24 may be approximately 20 milliamp (ma) LED's while the aisle light LEDs 31, etc. may be approximately 60 ma, each at a 12 volt A.C. input.

Figure 15:
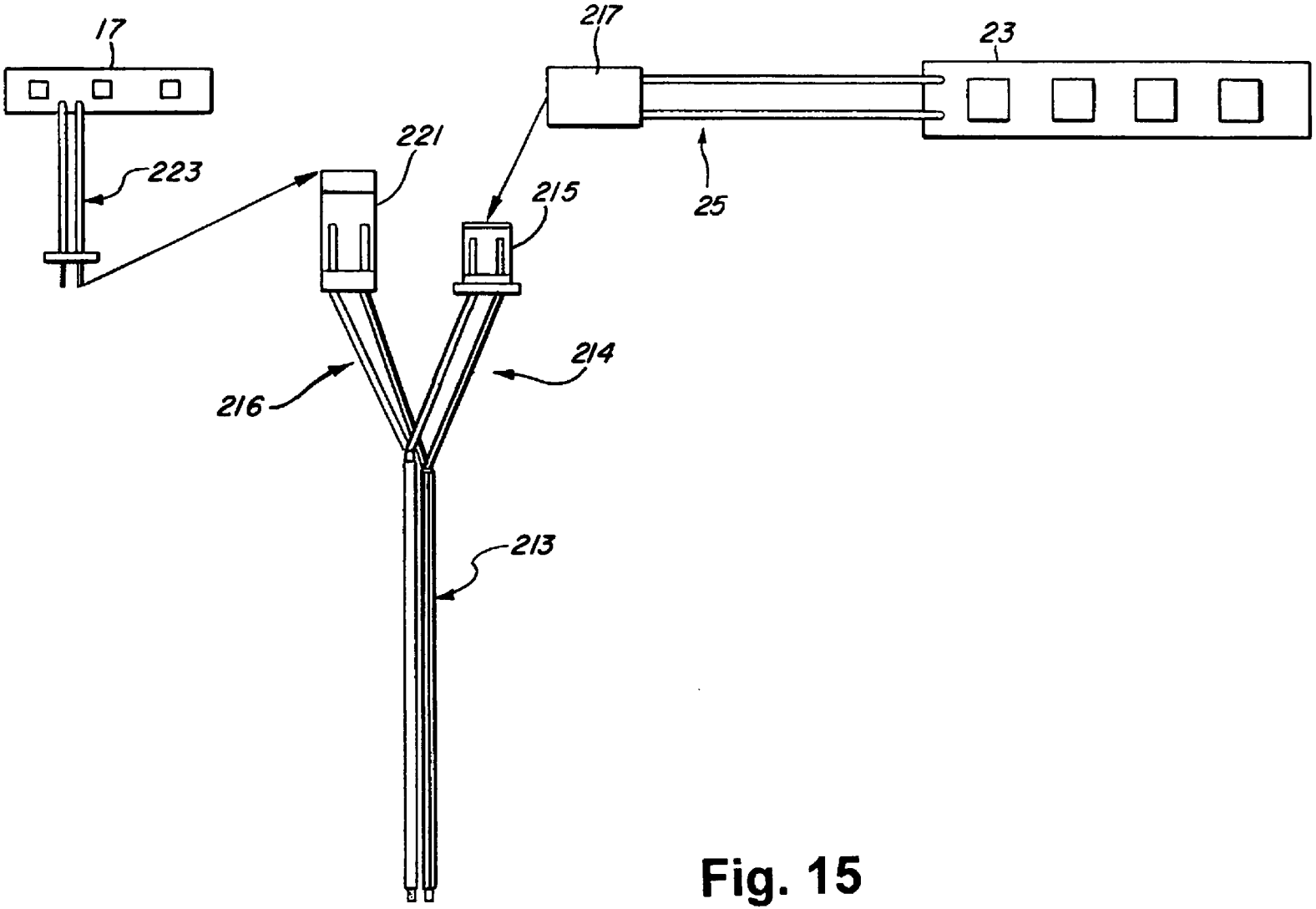
FIG. 15 is a schematic view of wiring for supplying power to backlight and aisle light LED circuit boards according to an illustrative embodiment.

Power to both LED circuit boards 17, 23 may be supplied via a quick disconnect connector for ease of maintenance. In one embodiment, power is supplied to the two backlight and aisle light circuit boards 17, 23 by a wire harness 213, as shown in FIG. 15. The harness 213 supplies power to respective female connectors 215, 221 via conductors 214, 216. The female connectors 215, 221 connect to respective male connectors 217, 219, which supply the circuit boards 17, 23 via respective conductor pairs 223, 225.

The wire harness 213 enters through a steel conduit 170 (FIG. 3), which is inserted in a cylindrical opening 225 of the light base 21. A set screw 227 threads into an opening 129 to fix the conduit 170 in place. The wiring is concealed in a cavity 230 formed by the back of the light shroud 19 and the pads 51, 53.

In one embodiment, the base plate 21 and cover 29 may be die-cast aluminum, the shroud 19 may be polycarbonate and the diffuser 27 and marker 25 may be acrylic. Other suitable metals, plastics, or composites could of course be used for various components in various alternate embodiments.

Those skilled in the art will appreciate that various adaptations and modifications of the just described embodiments can be configured without departing from the scope and spirit of the invention. In particular, the various values for dimensions of illustrative embodiments set forth above may differ in alternate embodiments. Therefore, it is to be understood that, within the scope of the appended claims, the invention may be practiced other than as specifically described herein.

What is claimed is:

1. Light fixture apparatus comprising:

a seat light base having a downwardly angled mounting surface and an upwardly angled mounting surface;

an LED shroud containing a first circuit board mounting a first plurality of LEDs, the shroud being mounted on said downwardly angled mounting surface;

a second circuit board mounting a plurality of LEDs, the second circuit board being positioned on said upwardly angled mounting surface; and a light cover mounted to said seat light base and having a plaque positioned thereon to be backlit by said second plurality of LEDs and having an end portion of a length selected to shield said first plurality of LEDs from view of persons walking up or down an aisleway, while directing illumination towards said aisleway.

2. The light fixture apparatus of claim 1 wherein the first circuit board is positioned flush against parallel horizontal rims located on an interior surface of said shroud.

3. The light fixture apparatus of claim 2 wherein the front surface of each of said first plurality of LEDs lies flush with a front surface of said shroud.

4. The light fixture apparatus of claim 3 wherein said plaque carries alpha and/or numeric indicia.

5. The light fixture apparatus of claim 3 wherein said downwardly angled surface lies at an angle of 20 degrees to a vertical.

6. The light fixture apparatus of claim 1 wherein said downwardly angled surface lies at an angle of 20 degrees to a vertical.

7. The light fixture apparatus of claim 1 wherein said seat light base has a flat back surface.

8. The light fixture apparatus of claim 1 wherein said plaque carries alpha and/or numeric indicia.

9. Light fixture apparatus comprising:

a seat light base;

a first plurality of LEDs positioned on the seat light to direct light downwardly;

a second plurality of LEDs positioned on the seat light to direct light upwardly; and a light cover mounted to said seat light base and having a plaque positioned thereon to be backlit by said second plurality of LEDs and having an end portion of a length selected to limit the visibility of said first plurality of LEDs to persons walking up or down an aisleway or other path, while directing illumination generated by said first plurality of LEDs toward said aisleway or path.

10. The light fixture apparatus of claim 1 wherein the first plurality of LEDs are mounted on a first circuit board which is positioned flush against parallel horizontal rims located on an interior surface of a shroud.

11. The light fixture apparatus of claim 10 wherein said first circuit board is mounted on a downwardly angled surface lying at an angle of 20 degrees to a vertical.

12. The light fixture apparatus of claim 2 wherein the front surface of each of said first plurality of LEDs lies flush with a front surface of said shroud.

13. The light fixture apparatus of claim 12 wherein said plaque carries alpha and/or numeric indicia.

14. The light fixture apparatus of claim 12 wherein said first circuit board is mounted on a downwardly angled surface lying at an angle of 20 degrees to a vertical.

15. The light fixture apparatus of claim 1 wherein said seat light base has a flat back surface.

16. The light fixture apparatus of claim 9 wherein said plaque carries alpha and/or numeric indicia.

* * * * *